US006905351B1

(12) United States Patent
Wang et al.

(10) Patent No.: US 6,905,351 B1
(45) Date of Patent: Jun. 14, 2005

(54) ELECTRICAL CONNECTOR FOR OPEN/CLOSE TYPE

(75) Inventors: Leland Wang, Tucheng (TW); Ming Chun Lai, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 10/814,509

(22) Filed: Apr. 1, 2004

(51) Int. Cl.[7] ..... H01R 13/44
(52) U.S. Cl. ..... 439/131
(58) Field of Search ..... 439/131, 140, 439/676, 946, 144

(56) References Cited

U.S. PATENT DOCUMENTS 5,664,955 A * 9/1997 Arnett ..... 439/135
6,142,834 A * 11/2000 Liao ..... 439/676
6,190,186 B1 * 2/2001 Liao ..... 439/144
6,193,522 B1 * 2/2001 Liao ..... 439/144

* cited by examiner

*Primary Examiner*—Tho D. Ta
(74) *Attorney, Agent, or Firm*—Rosenberg, Klein & Lee

(57) ABSTRACT

An electrical connector for open/close type includes a base member, at least a terminal member to setup on the base member and a cover member to fit on top of base member. An interlock member connects the cover member with the base member. The electrical connector allows the cover member to be opened and closed corresponding to the body member. Besides, a receiving space is formed between the cover member and with the base member receiving a plug of the jack module. The cover keeps parallel to the base member in order to reduce the thickness of the electrical connector.

11 Claims, 11 Drawing Sheets

ELECTRICAL CONNECTOR FOR OPEN/CLOSE TYPE

BACKGROUND OF THE INVENTION

1. Field of the Invention

The present invention generally relates to the field of an electrical connector for open/close type, and in particular to an electrical connector comprising a cover member which can be opened and closed. An adapted connector can be inserted into the electrical connector as the cover member is opened. The cover member can be closed when the electrical connector is not used. Whatever the cover member is in the state of open or close, the electrical connector can meet the requirements of thin size and easy carrying.

2. The Related Art

Following the improvement of the technologies, a variety of communication apparatuses are produced satisfying the requirements of utilized conveniently, enhanced functions, small size and carry easily. These apparatuses transmit and receive signals through the signal cable. Accordingly, the related signal receiver or storage device of most desktop Personal Computer (PC), portable PC or other electronic products are provided with the electrical connector of standard specification. Please refer to FIG. 11. PCMCIA (Personal Computer Memory Card International Association) card 100 is used for communication link, such as linking the communication of portable PC and Ethernet LAN (Local Area Network) or linking the Data/Fax modem (modulator-demodulator) to the subscriber telephone system. Therefore, the electrical connector 10*a* is complied with the standard specification of RJ series equipped on the side of the PCMCIA card 100, such as RJ11, RJ45 connectors, etc. When the communication link is worked, one end of a communication plug is connected with the Ethernet LAN and the other end inserted in the electrical connector 10*a* of the PCMCIA card 100, the signals transmitting and receiving can be achieved.

Nevertheless, the above-mentioned electrical connector 10*a* has following problems under operation (1) The electrical connector 10*a* of RJ series is the standard specification, so it has a specific size. However, the regular thickness of PCMCIA card 100 is much less than the specific thickness of the electrical connector 10*a* of RJ series. As shown in FIG. 11, the PCMCIA card 100 has a larger thickness of the side of the electrical connector 10*a*. The larger thickness causes the larger size of the PCMCIA card 100, and it also bring user the inconvenient of store and carry. Furthermore, as the portable PC, the assembly of the electrical connector 10*a* within the portable PC will be limited by the size of the electrical connector 10*a*.

(2) The insert hole of the electrical connector 10*a* is exposed outside, it may causes the dust cover on the terminals and the defect of electrical contact.

In order to solve the foregoing problems, there is a prior art of an electrical connector for open/close type as disclosed in the U.S. Pat. No. 5,679,013. The electrical connector comprises: a base member having an upper face defining an aperture; a cover member for opening and closing the aperture of the base member; means defining a receiving face disposed in the base member for receiving a counter electrical connector having a rectangular parallelopiped shape; at least one terminal member disposed in the base member, and being elastically in contact with a terminal of the counter electrical connector, the cover member being pivotally supported in one end portion of said base member for rotation between an opened position and a closed position, the cover member defining thereby an axis of rotation, the cover member and the receiving face of the base member forming an accommodating space for the counter electrical connector when the cover member is in its opened position, and the cover member and the receiving face sandwiching the counter electrical connector; an engagement mechanism engageable with an engagement portion of the counter electrical connector, thereby preventing the counter electrical connector from slipping out of the base member; and an open position restricting mechanism for restricting an open angle of said cover member with respect to the base member, the cover member defining a back face and the receiving face defining a supporting face which is substantially parallel to the back face of the cover member when the cover member is in its opened position.

The above-mentioned electrical connector disclosed in U.S. Pat. No. 5,679,013, the cover member is only pivotally supported in one side of the base member by a pivot. While the cover member is in the open state, the cover member is rotary up to open an angle of inclination for counter connector inserted obliquely in the electrical connector. However, the pivot may escape from the pivotal hole of the electrical connector because the excessive up forces while open the cover member, and it causes the cover member separated from the base member. Therefore, the assembly of the electrical connector is unstable. Although the cover member of the electrical connector would be drawn back to a thin condition in the close state, the cover member has an angle of inclination when it is in open state. It causes the electrical connector has a specific thickness while the counter connector inserted. Accordingly, the electrical connector has a larger size while it is in operation.

SUMMARY OF THE INVENTION

It is therefore a primary objective of the present invention to provide an electrical connector for open/close type which comprises a base member, a cover member set above the base member, the cover member and the front side and the rear side of the base member are assembled by interlock device. The cover member can be opened or closed relative to the base member in parallel direction. There is a containing space formed between the base member and the cover member for containing a corresponding connector. Whatever the cover member is in the close state, open state or under a moving state, the cover member is in parallel relative to the base member. The electrical connector can be drawn back to a thin condition by utilized the present invention while the electrical connector is not in operation. The electrical connector still can be operated without larger space. The present invention attains the requirements of small size and easy carrying and use.

Another object of the present invention is to provide an electrical connector for open/close type wherein the interlock devices set on the cover member and the front side and rear side of the base member. Each of the interlock device comprises interlock levers. The cover member can be moved horizontally to the base member by the interlocking movement of the interlock levers. Therefore, the open state and the close state of the electrical connector can be achieved.

A still further object of the present invention is to provide an electrical connector for open/close type which comprises a resilient device. The resilient device is retained a restoring force when the cover member is in open state. As a corresponding connector is rejected from the containing space formed between the base member and the cover member, the cover member will be closed itself on the top of the base member by the restoring force of the resilient devices.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
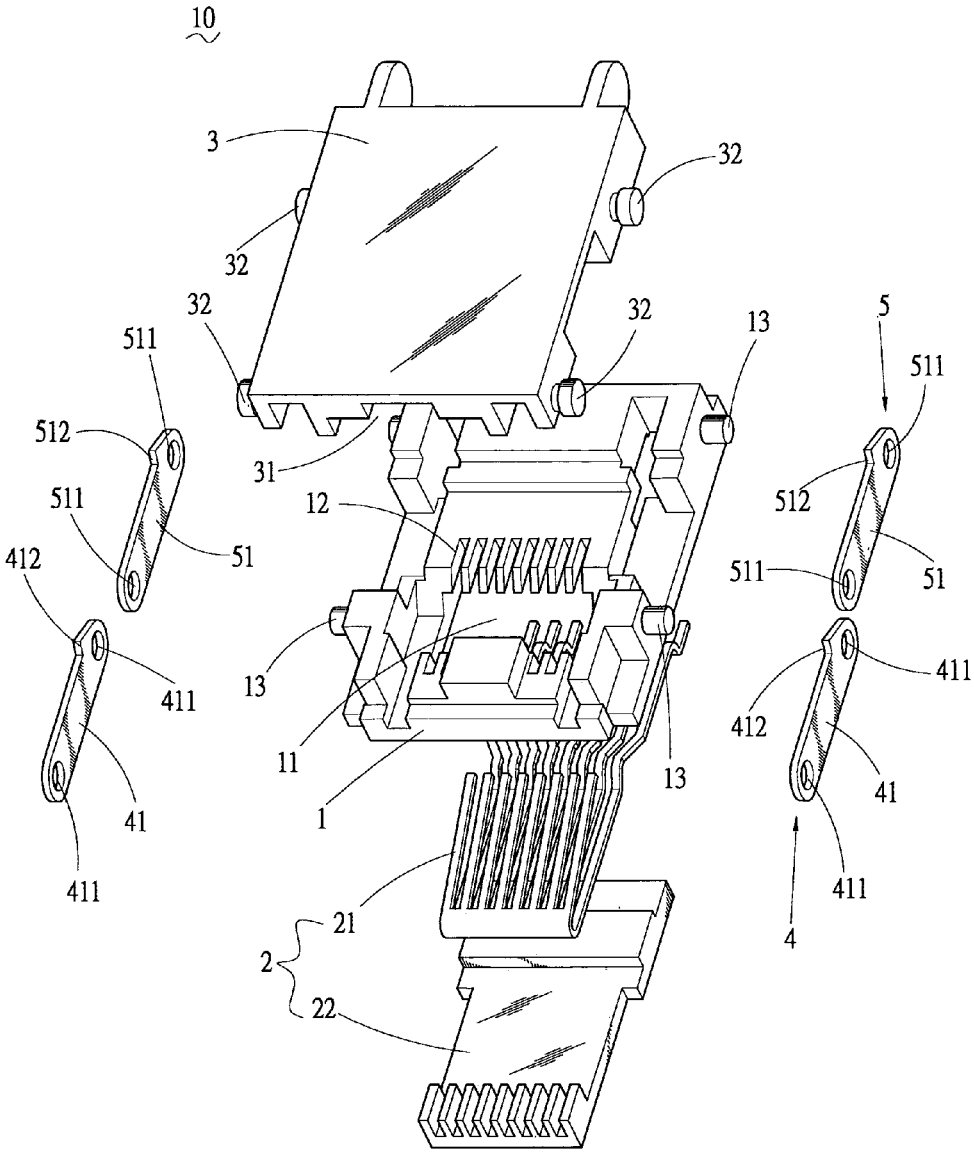
FIG. 1 is an exploded view of an electrical connector in accordance with the present invention.

Please refer to FIG. 1 showing an electrical connector 10 which is a RJ-45 modular jack utilized for receiving a communication modular plug 20 inserted inside the electrical connector 10 to transmit and receive the signals. The electrical connector 10 includes a base member 1 having a containing portion 11 formed on the base member 1. There are a plurality of the terminal grooves 12 formed in the containing portion 11. A terminal assembly 2 is set on the base member 1. The terminal assembly 2 comprises a plurality of terminals 21 and a terminal base 22. The terminals 21 are embodied on the terminal base 22, then the terminal base 22 is set on the base member 1, and the terminals 21 are placed in the terminal grooves 12.

According to the present invention, a cover member 3 is set on above of the base member 1. The cover member 3 and the front side and rear side of the base member 1 are combined by interlock devices 4 and 5. The cover member 3 can be moved horizontally relative to the base member 1 and achieved an open/close state. Furthermore, a containing space 101 (shown in FIG. 3) is formed between cover member 3 and the base member 1 for containing a modular plug 20. In this embodiment, there is an arm portion 201 set on the top of the modular plug 20. A latch recess 31 is formed on the front side of the cover member 3. When the modular plug 20 is inserted inside the electrical connector 10, the arm portion 201 latches with the latch recess 31 of the cover member 3, and the modular plug 20 can be retained and latched in the electrical connector 10.

In the first embodiment according to the present invention shown in FIG. 1, the interlock devices 4 and 5 are individually set on the front side and rear side of the base member 1 and the cover member 3. The front interlock devices 4 and rear interlock devices 51 are comprised of the interlock levers 41 and 51. Each of the interlock devices 4 and 5 comprises two interlock levers 41 and 51. Accordingly, there are four interlock levers within the first embodiment in accordance with the present invention. The interlock levers 41 and 51 are in the form of strait sheet. There are pivotal holes 411 and 511 set on the top end and bottom end of the interlock levers 41 and 51. The pivots 13 and 32 are respectively set on the position on the base member 1 and the cover member 3 corresponding to the pivotal holes 411 and 511 of the interlock levers 41 and 51.

Figure 2:
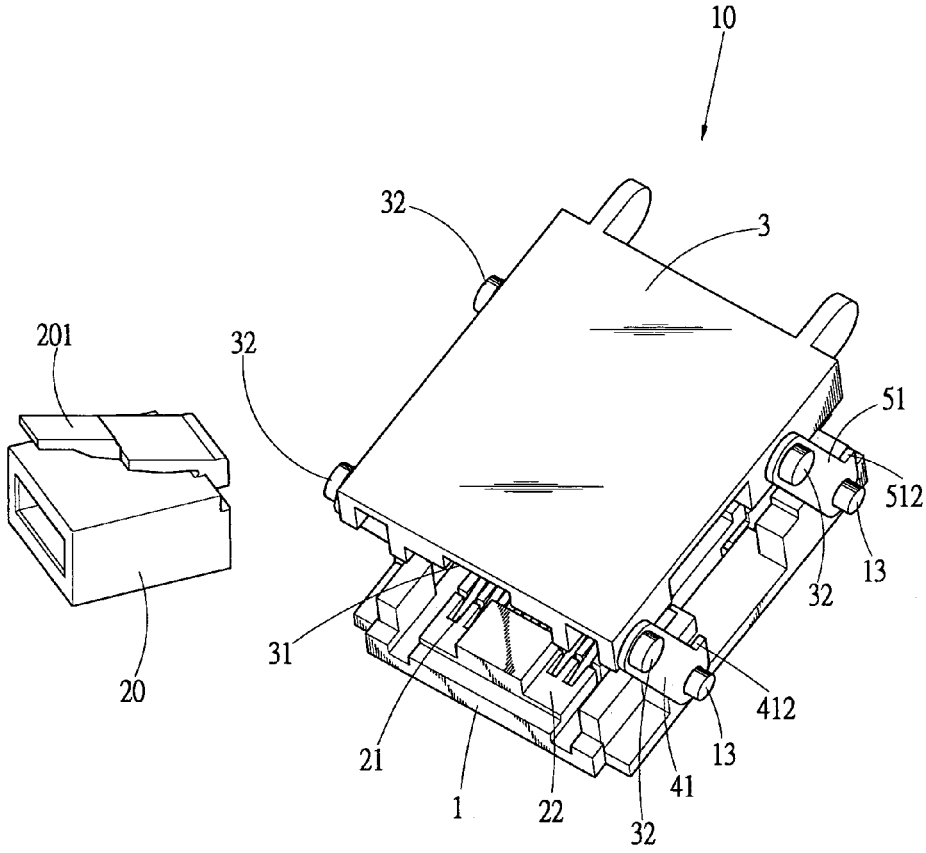
FIG. 2 is a perspective view of the electrical connector according to the present invention which is in open state.
Figure 3:
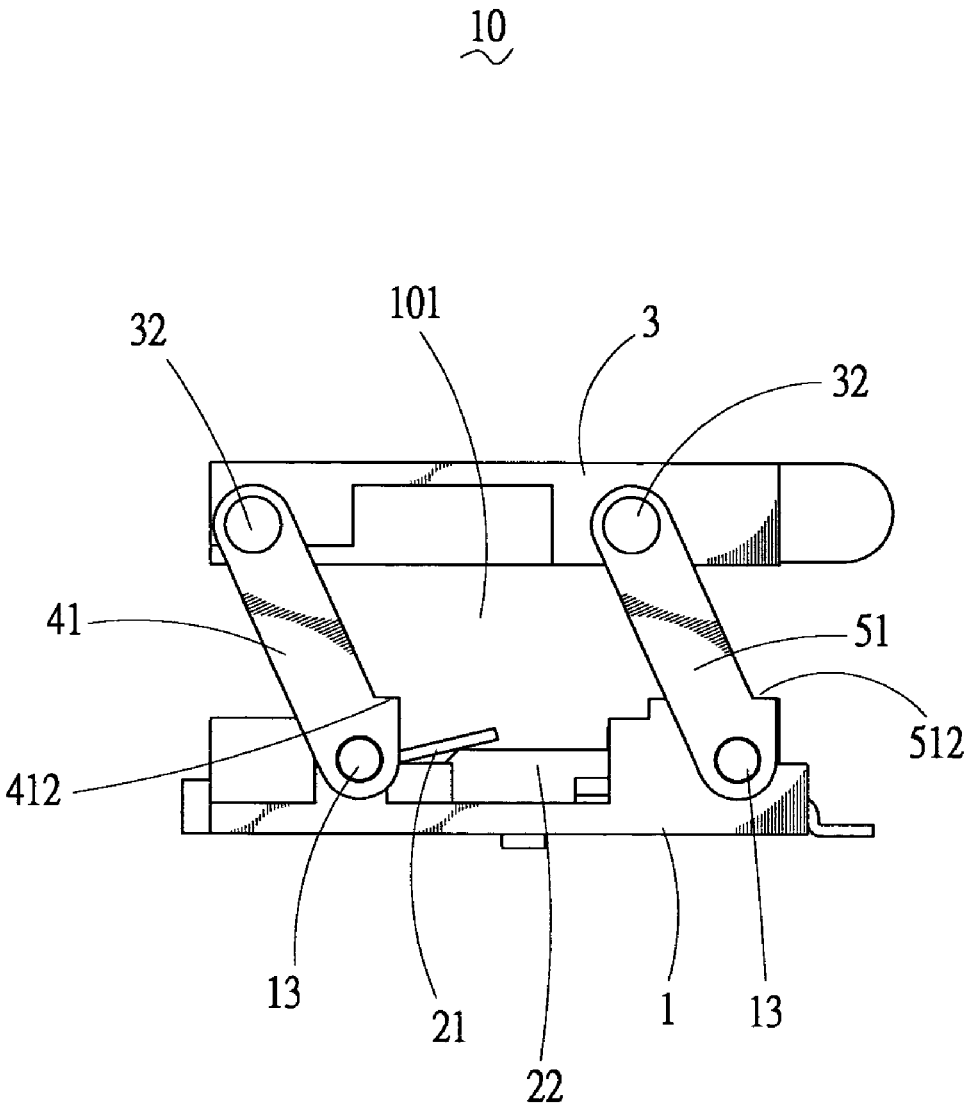
FIG. 3 is a perspective view of the electrical connector in accordance with the present invention viewing from the lateral side.
Figure 4:
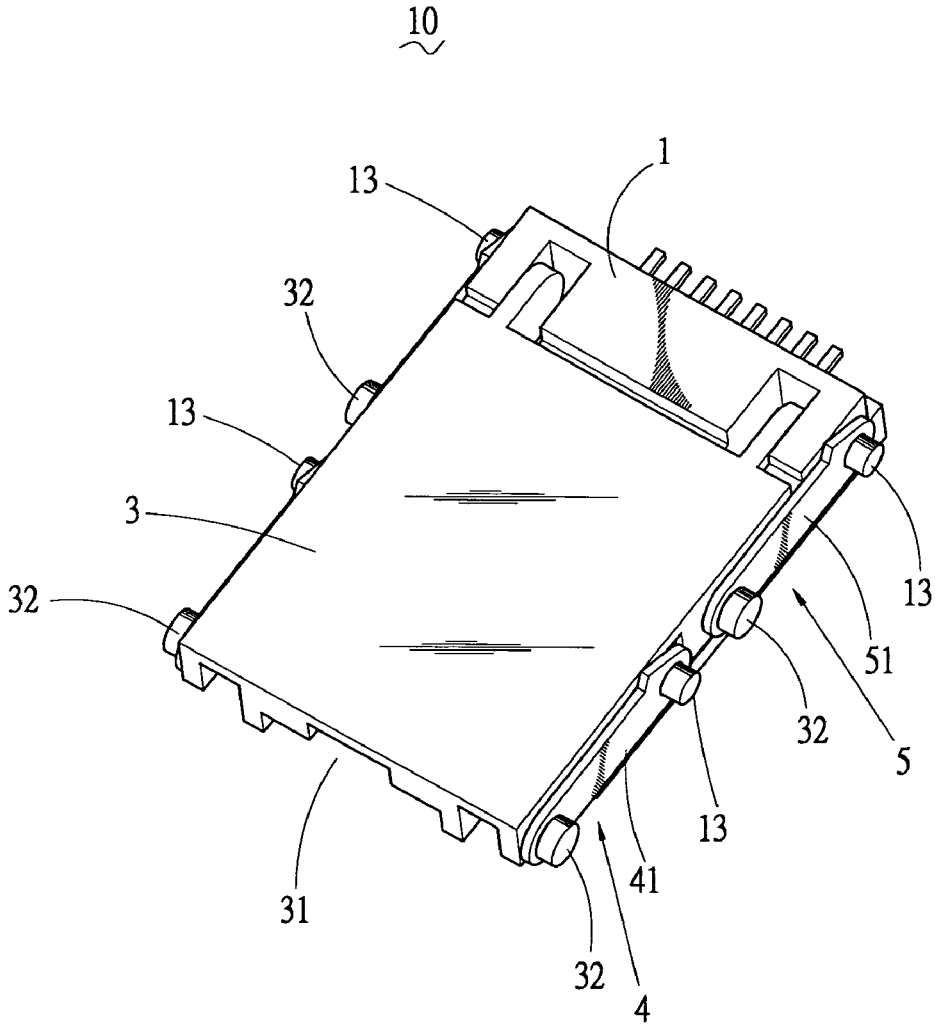
FIG. 4 is a perspective view of the electrical connector according to the present invention which is in close state.

Please refer to FIG. 2 and FIG. 3. A plurality of terminals 21 of the terminal assembly 2 are assembled individually in the terminal base 22, and the terminal base 22 is assembled upwardly from the bottom of the base member 1. The terminal base 22 is embodied on the base member 1, and each terminal 21 are arranged individually in the terminal grooves 12. Subsequently, the pivotal holes 411, 511 of the interlock levers 41, 51 are coupled to the pivots 13, 32 of the base member 1 and cover member 3. The base member 1 and the cover member 3 are assembled by setting pivots 13, 32 into the respective pivotal holes 411, 511 of the four interlock levers 41, 51 of the front interlock device 4 and the rear interlock device 5. The cover member 3 therefore can be in the open state (shown in FIG. 2) or in the close state (shown in FIG. 4) relative to the base member 1. When the cover member 3 is in open state, there is a containing space 101 formed between the cover member 3 and the base member 1 for containing the modular plug 20.

Figure 5:
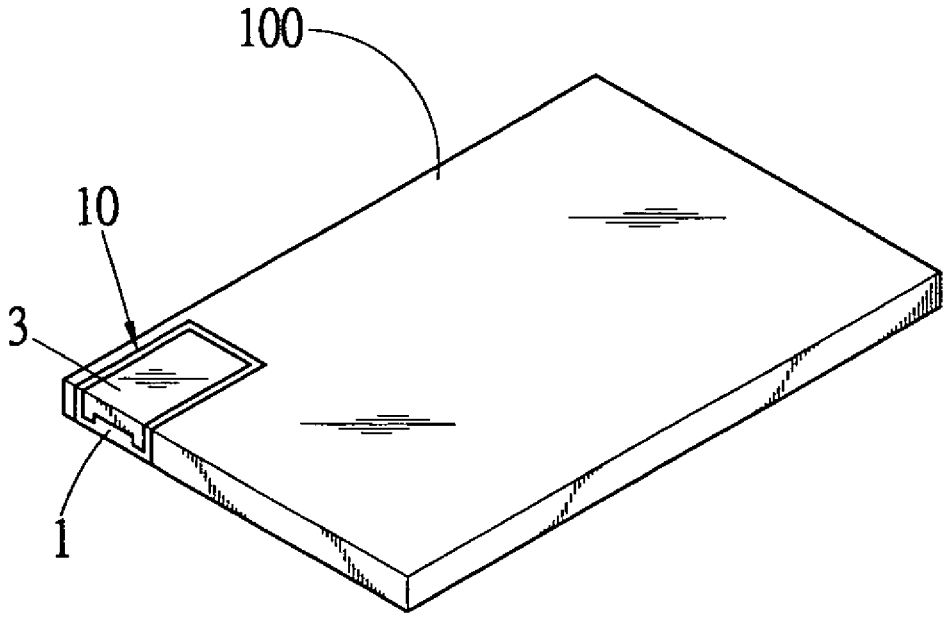
FIG. 5 is a schematic view of the electrical connector according to the present invention which is utilized on a PCMCIA card.
Figure 6:
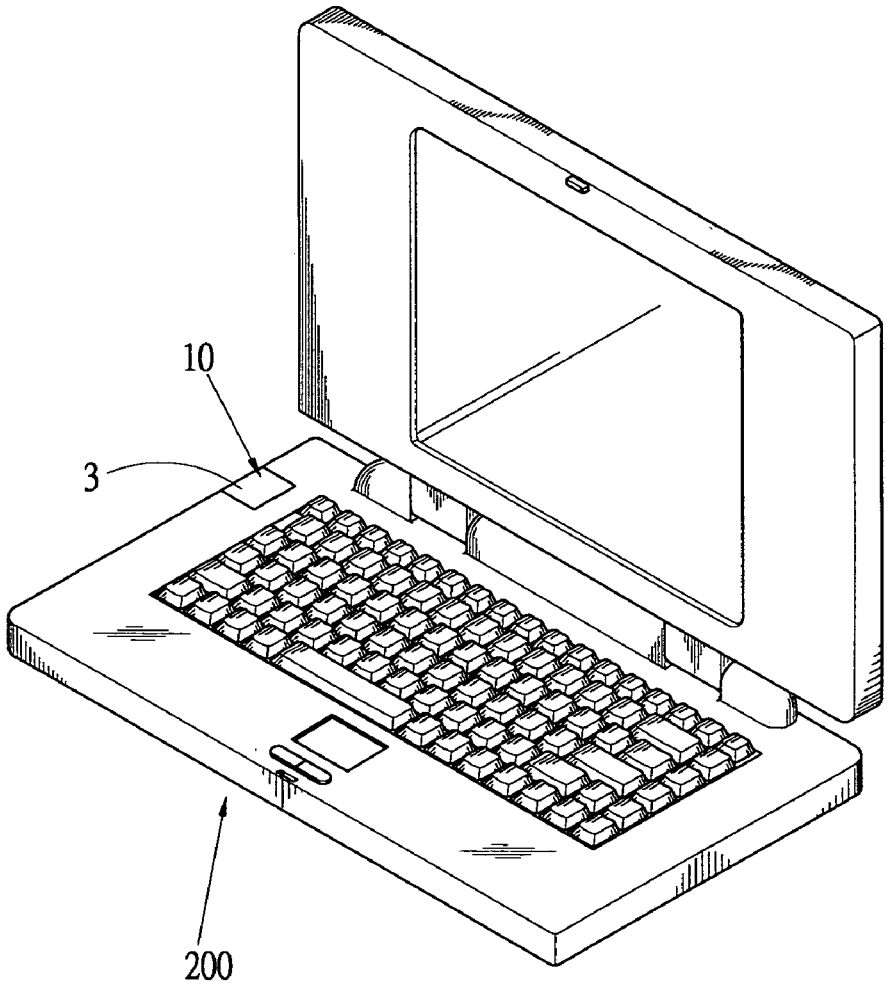
FIG. 6 is a schematic view of the electrical connector according to the present invention which is utilized on a portable PC.

Please refer to FIG. 5. The electrical connector 10 is applied on a PCMCIA card 100 for communication link in this embodiment. The cover member 3 is in close state while the PCMCIA card 100 is not in operation, in the meantime, the top of the cover member 3 can be aligned with the top of the PCMCIA card 100. Thus the whole size of the PCMCIA card 100 can be thinned for the requirements of carrying and use conveniently. Please refer to the FIG. 6. The electrical connector 10 is applied on the portable PC 200 in this embodiment. As the electrical connector 10 can be in open state and close state, hence the electrical connector 10 can be set on any position on the portable PC 200.

Figure 7:
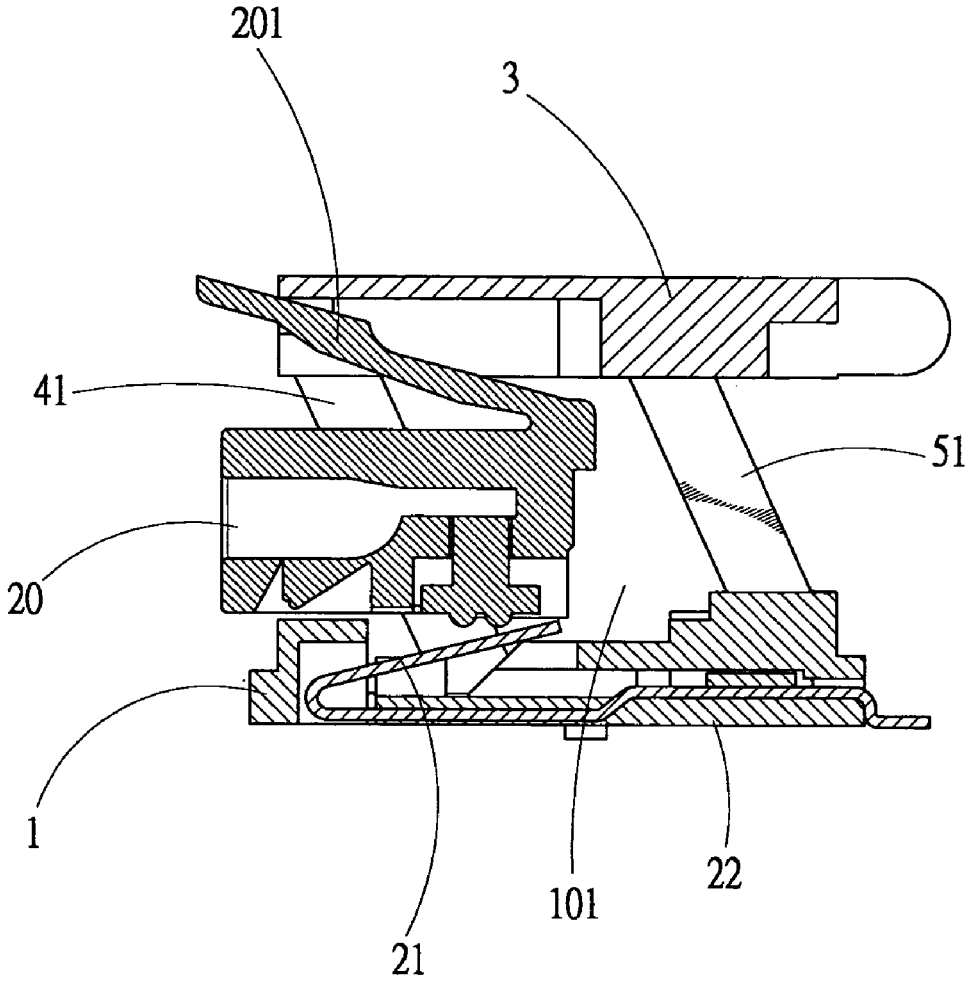
FIG. 7 is a lateral cross-sectional view of the electrical connector according to the present invention while the corresponding connector is plugged inside.

Please refer to FIG. 7. When the cover member 3 is moved from close state to open state, an upward force is needed to apply on it, thereat the cover member 3 can be moved upwardly in parallel by support of the interlock levers 41, 51. Because the interlock levers 41, 51 set on the front side and rear side of the cover member 3 pivotally, the cover member 3 is moved in parallel, that is, whatever the cover member 3 is in open state or close state which can be paralleled the base member 1. Furthermore, the height of the electrical connector according to the present invention in open state is lower than prior design, and the electrical connector does not occupied a larger space in corresponding electronic apparatuses. The modular plug 20 can be inserted into the containing space 101 formed between the base member 1 and the cover member 3 as the cover member 3 is in open state, in the meanwhile, the modular plug 20 contacts with the terminals 21 for transmitting and receiving signals.

After the modular plug 20 is rejected from the electrical connector 10, a downward force is needed to apply on the cover member 3, then the cover member 3 can be retracted to the base member 1. The electrical connector 10 can be retracted to a thin size for the objects of small size and saving the space of the corresponding electronic apparatus.

Figure 8:
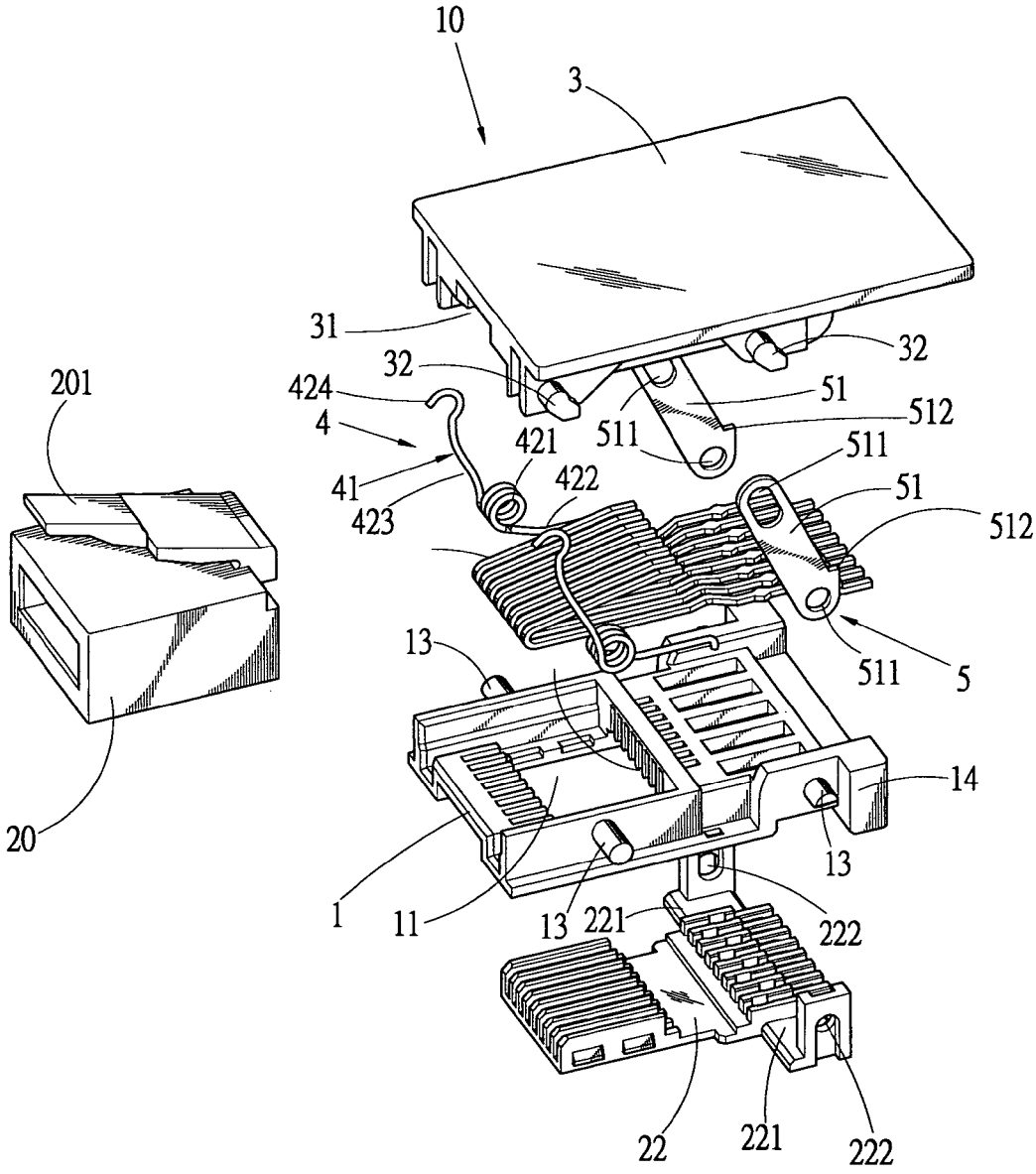
FIG. 8 is an exploded view of a second embodiment according to the present invention.

Please refer to FIG. 8. In the second embodiment of the electrical connector 10 of the present invention, the cover member 3 can be closed itself by resilient devices. The interlock levers 51 of rear interlock device 5 are set on the rear side of the base member 1 and cover member 3. The interlock lever 51 is formed of the strait sheet. The top end and bottom end of the interlock lever 51 have pivotal holes 511 formed thereon. A stop portion 512 is set outwardly on the bottom end of the interlock lever 51. The left and right sides of the rear side of the base member 1 set outwardly a stop protrusion 14. The rotary angle of the interlock levers 51 can be limited by the cooperation of the stop protrusions 14 and the stop portions 512. The terminal base 22 is set outwardly the L-shaped coupled members 221 both on the left and right sides of the rear side thereof. A coupled hole 222 is formed on the coupled member 221 for coupling to the respective pivot 13 of the base member 1 as the terminal base 22 installed with the base member 1, and the cooperation of the coupled members 221 and the pivots 13 is supported to prevent the interlock levers 51 separating from the respective pivots 13.

In the second embodiment, the front interlock device 4 is fabricated by two torsion springs 42. The torsion spring 42 comprises a circular pivotal portion 421 pivotally coupled to the respective pivot 13 on the lateral of the front side of the base member 1. One end of the pivotal portion 421 is stretched out a retaining arm 422 to against the base member 1, the other end of the pivotal portion 421 is stretched out a spring arm 423. The free end of the spring arm 423 is formed in a shape of hook for pivotally hooking with the respective pivot 32 on the front side of the cover member 3.

Figure 9:
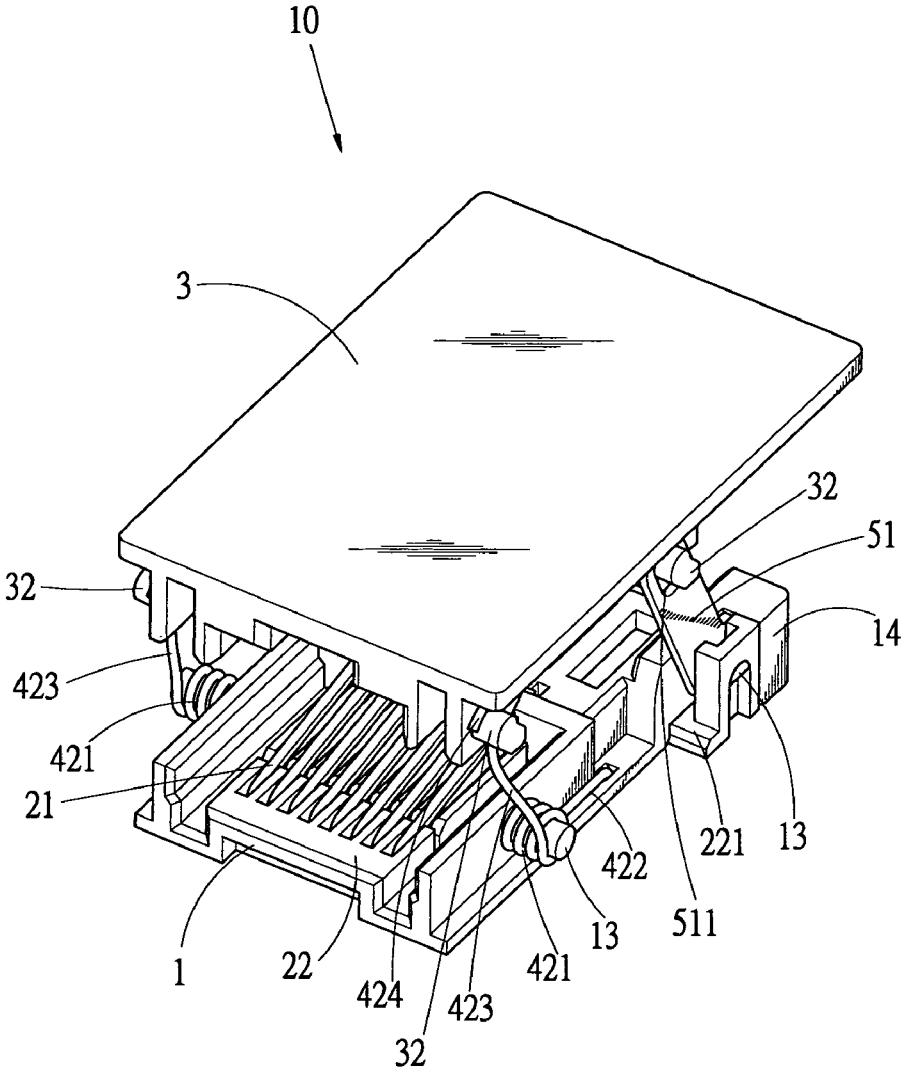
FIG. 9 is a perspective view of the second embodiment according to the present invention which is in open state.

Please refer to FIG. 9. When the cover member 3 is moved from close state to open state, an upward force is needed to apply on it, thereat the cover member 3 can be moved upwardly in parallel by support of the interlock levers 51 and two torsion springs 42. As the stop portion 512 of the interlock lever 51 installed on the rear side of the electrical connector 10 against the lateral wall of the respective stop protrusions 14 of the base member 1, the cover member 3 can be limited on a predetermined position. In the meanwhile, the modular plug 20 can be inserted in the containing space formed between the base member 1 and the cover member 3, and the modular plug 20 contacts with the terminals 21 to allow transmitting and receiving signals. At that time, the spring arm 423 of the torsion spring 42 is pulled backwardly as the cover member 3 open upwardly, and the torsion spring 42 is stored a resilient restoring force.

Figure 10:
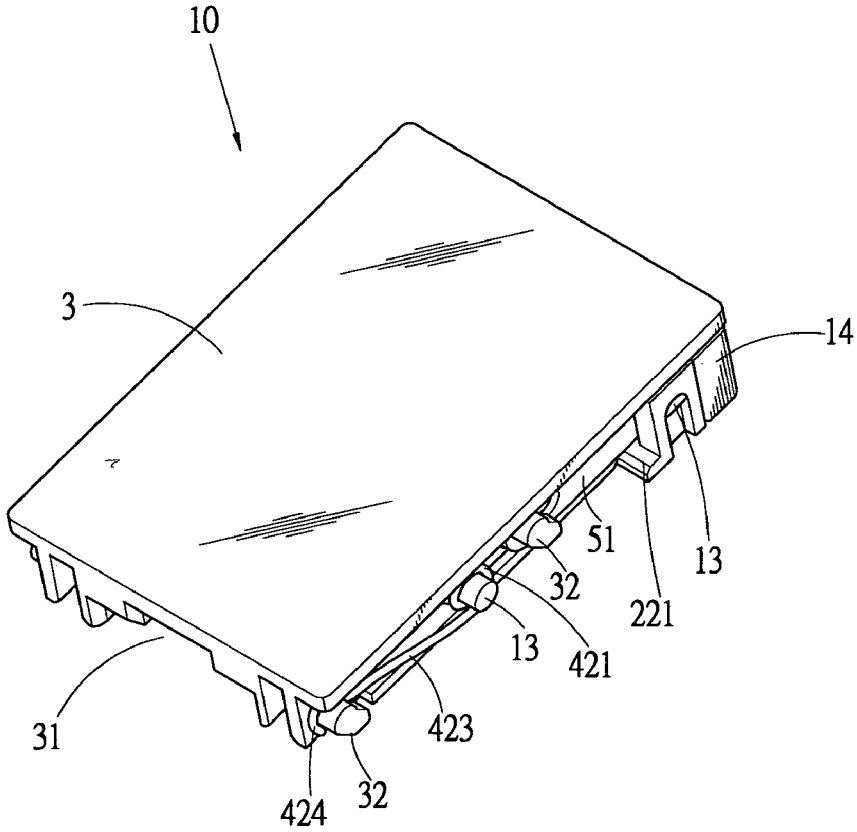
FIG. 10 is a perspective view of the second embodiment according to the present invention which is in close state.
Figure 11:
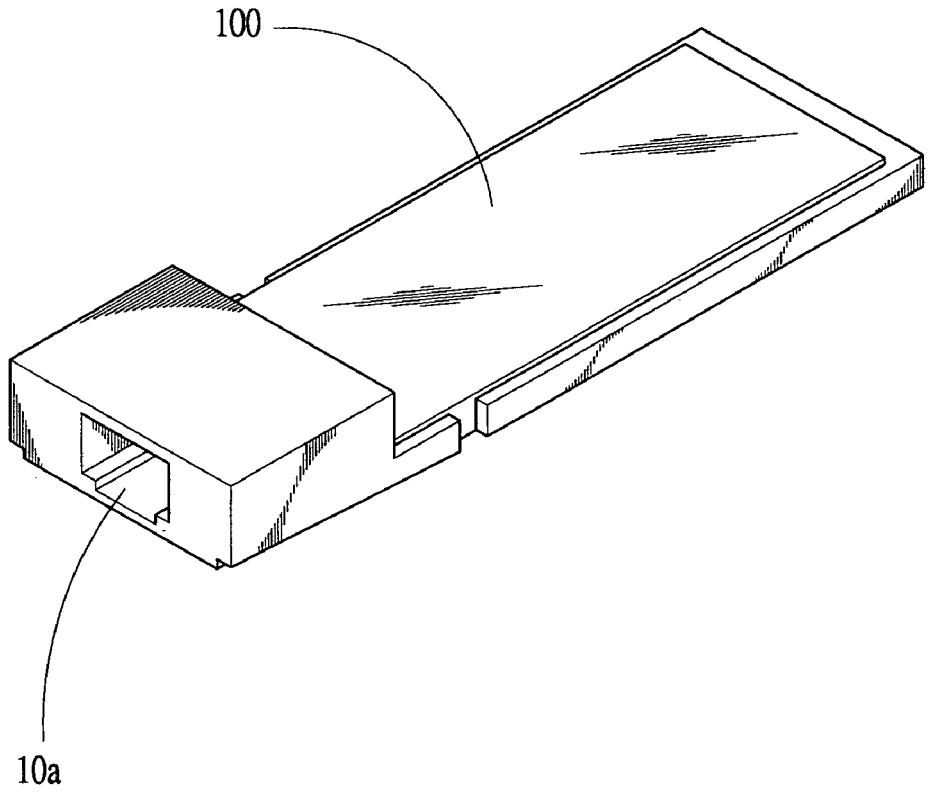
FIG. 11 is a schematic view of the electrical connector of prior art.

Please refer to FIG. 10. After the modular plug 20 is rejected from the containing space formed between the cover member 3 and the base member 1, the cover member 3 can be retracted itself to a natural position on the base member by the actuation of the resilient restoring force of the torsion spring 42 without the support of the modular plug 20. Accordingly, the cover member 3 is self-closed in this embodiment according to the present invention.

The forementioned embodiments have clarified that the open/close type of electrical connector in accordance with the present invention can be drawn back to a thin condition while the electrical connector is not in operation, and the electrical connector still can be operated without larger space than prior art. Therefore, the present invention attains the requirements of small size and carry and use easily.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An open/close type electrical connector comprising:

a base member;

a terminal assembly set on said base member for coupling and contacting with a connector;

a cover member set above said base member, said cover member being displaceable between an open state and a closed state relative to said base member, said cover member and said base member forming a containing space adapted to receive said connector in said open state, said cover member having a latch recess on a front side thereof, said connector being provided with an arm portion adapted to latch in said latch recess; and an interlock device respectively connecting a front side and a rear side of said cover member with said base member, said interlock device supporting said cover member to move in parallel, said cover member being disposed in parallel relationship with said base member in said state of open, said closed state and while moving.

2. The open/close type electrical connector as claimed in claim 1, wherein said connector is a modular plug.

3. The open/close type electrical connector as claimed in claim 1, wherein said terminal assembly includes a plurality of terminals and a terminal base.

4. The open/close type electrical connector as claimed in claim 3, wherein a rear side of said terminal base has a pair of outwardly directed L-shaped coupled members respectively disposed on opposing sides thereof and each coupled member has a coupled hole formed therein.

5. An open/close type electrical connector comprising:

a base member;

a terminal assembly set on said base member for coupling and contacting with a connector;

a cover member set above said base member, said cover member being displaceable between an open state and a closed state relative to said base member, said cover member and said base member forming a containing space adapted to receive said connector in said open state; and an interlock device respectively connecting a front side and a rear side of said cover member with said base member, said interlock device supporting said cover member to move in parallel, said cover member being disposed in parallel relationship with said base member in said state of open, said closed state and while moving, said interlock device including a front interlock device and a rear interlock device for respectively coupling a front side and rear side of said base member to corresponding sides of said cover member, said front interlock device and said rear interlock device being interlock levers.

6. The open/close type electrical connector as claimed in claim 5, wherein said interlock lever is formed of a strait sheet having a pivotal hole set individually on a top end and a bottom end of said interlock levers, said base member and said cover member each having pivots respectively disposed at positions corresponding to said pivotal holes of said interlock levers.

7. An open/close type electrical connector comprising:

a base member;

a terminal assembly set on said base member for coupling and contacting with a connector;

a cover member set above said base member, said cover member being displaceable between an open state and a closed state relative to said base member, said cover member and said base member forming a containing space adapted to receive said connector in said open state; and an interlock device respectively connecting a front side and a rear side of said cover member with said base member, said interlock device supporting said cover member to move in parallel, said cover member being disposed in parallel relationship with said base member in said state of open, said closed state and while moving, said interlock device including a front interlock device and a rear interlock device for respectively coupling a front side and rear side of said base member to corresponding sides of said cover member, said rear interlock device being an interlock lever and said front interlock device being a resilient device, said cover member being self retractable on said base member utilizing said resilient device.

8. The open/close type electrical connector as claimed in claim 7, wherein said resilient device includes at least a torsion spring respectively installed on left and right sides of said electrical connector.

9. The open/close type electrical connector as claimed in claim 8, wherein said torsion spring includes a circular pivotal portion pivotally coupled to a respective pivot on a lateral of said base member, one end of said pivotal portion forming a retaining arm extending outwardly to contact said base member, an other end of said pivotal portion extending outwardly to form a spring arm, a free end of said spring arm being hook-shaped.

10. The open/close type electrical connector as claimed in claim 7, wherein said interlock lever is formed of a strait sheet having a pivotal hole set individually on a top end and a bottom end of said interlock levers, said base member and said cover member each having pivots respectively disposed at positions corresponding to said pivotal holes of said interlock levers.

11. The open/close type electrical connector as claimed in claim 10, wherein each said interlock lever has an outwardly directed stop portion on a rear side of a bottom end thereof, said base member having a stop protrusion extending outwardly on each of opposing sides of said rear side thereof, rotary angle of said interlock levers being limited by cooperation of said stop protrusions and said stop portions.

* * * * *